US006279489B1

(12) United States Patent
Daniel

(10) Patent No.: US 6,279,489 B1
(45) Date of Patent: Aug. 28, 2001

(54) MULTIPLE UTILITY TABLE

(76) Inventor: Robert Pike Daniel, 3884 Fredonia Dr. #D, Los Angeles, CA (US) 90068

( * ) Notice: Subject to any disclaimer, the term of this patent is extended or adjusted under 35 U.S.C. 154(b) by 0 days.

(21) Appl. No.: 09/492,340

(22) Filed: Jan. 27, 2000

(51) Int. Cl.[7] ..... A47B 57/00
(52) U.S. Cl. ..... 108/92; 108/50.01
(58) Field of Search ..... 108/92, 50.01, 108/50.02, 59, 64, 176; 312/195, 196

(56) References Cited

U.S. PATENT DOCUMENTS

| | | | | |
|---|---|---|---|---|
| 2,010,278 | | 8/1935 | Snyder . | |
| 2,213,828 | | 9/1940 | Thomas . | |
| 3,034,841 | * | 5/1962 | Blevins | 108/92 X |
| 3,602,160 | | 8/1971 | Heal . | |
| 4,083,597 | | 4/1978 | Dowdy . | |
| 4,646,655 | * | 3/1987 | Robolin | 108/92 |
| 4,648,652 | | 3/1987 | Van Kuren . | |
| 4,700,987 | | 10/1987 | Sraka et al. . | |
| 4,852,500 | * | 8/1989 | Ryburg et al. | 108/50.02 X |
| 5,357,873 | * | 10/1994 | Hilton | 108/92 X |
| 5,419,525 | * | 5/1995 | Hilton | 108/50.01 X |
| 5,623,881 | * | 4/1997 | Huang | 108/92 X |
| 5,765,315 | * | 6/1998 | Nagamitsu et al. | 108/92 X |
| 5,967,631 | * | 10/1999 | Ko | 108/92 X |
| 6,003,452 | * | 12/1999 | Moore | 108/50.01 X |
| 6,161,487 | * | 12/2000 | Chang | 108/50.01 |

* cited by examiner

*Primary Examiner*—Jose V. Chen
(74) *Attorney, Agent, or Firm*—Goldstein Law Offices, P.C.

(57) ABSTRACT

A table, for allowing several people to comfortably sit at a couch or a similar seating system, with their legs extending comfortably under the table. Accordingly, the table has an upper level and a lower level and comprises seating portions and non-seating portions. At the seating portions the upper level extends forward while the lower level is recessed rearward, so that a person can sit comfortably with their legs extending under the upper level. At the non-seating portions the lower level extends forward and the upper level is recessed rearward. The table has a table front and a table rear. Seating portions and non-seating portions are alternated along both the table front and table rear. The table is made up of a plurality of adjacent sections, wherein each section is made up of one seating portion and one non-seating portion.

10 Claims, 3 Drawing Sheets

MULTIPLE UTILITY TABLE

BACKGROUND OF THE INVENTION

The invention relates to a multiple utility table. More particularly, the invention relates to a table which is configured so as to be useful for a variety of purposes.

In homes around the world, the most common type of table found in front of couches and other casual seating is a "coffee table". A standard coffee table is approximately eighteen inches high. Such a height makes the coffee table ideal as a footrest, for holding books and magazines, and for holding a variety of other objects while not obscuring the view of people seated at the couch. However, this height makes the coffee table unsuitable for use when eating, reading, or working at the couch.

Because most coffee tables are even lower than the knees of a person seated at a couch, the person must both lean forward and crouch downward in order to use the coffee tabletop as an eating surface or a work surface. This position is extremely uncomfortable and can even lead to back pain and muscle aches over a period of time.

As a result, many have proposed devices which allow one to more easily work or eat at the couch. Such devices generally take the form of lap desks and other devices which are based on the assumption that the coffee table is too unsuitable to even be adapted to carry out the desired tasks.

While these units may be suitable for the particular purpose employed, or for general use, they would not be as suitable for the purposes of the present invention as disclosed hereafter.

SUMMARY OF THE INVENTION

It is an object of the invention to produce a table which is suitable for use in front of a couch or chair, but which allows a variety of activities to be carried out therewith which could not be carried out effectively with a conventional coffee table.

It is another object of the invention to provide a table which allows a person to eat, work, and read at the table while comfortably seated in the couch or chair. Accordingly, the table is situated so that it provides a convenient surface immediately adjacent to the lap of the user.

It is a further object of the invention to provide a table which prevents inadvertent ankle injuries. Accordingly, the table legs are positioned so that they do not interfere with the user's legs as the user stands up toward the side of the table.

It is a further object of the invention to provide a table which is useable from opposite sides and which allows several people to work, eat, or read at the same time. Accordingly, the staggered configuration of the table in its standard configuration allows three people to work at the table, wherein each person is seated comfortably and also has his or her own expansive workspace.

It is a still further object of the invention to provide a table which is modular so that it can be configured in numerous ways, for accomplishing numerous different uses.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
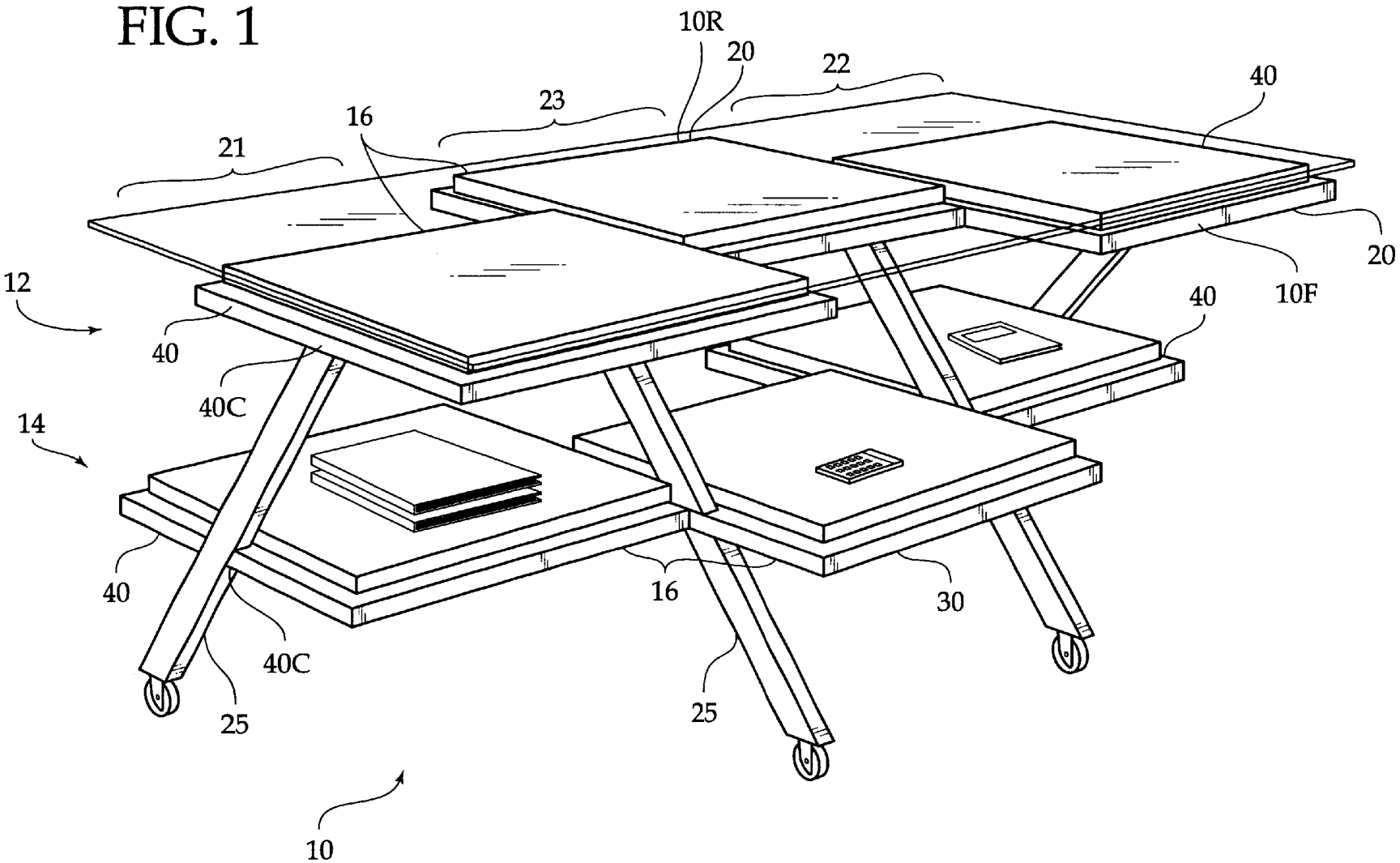
FIG. 1 is a diagrammatic perspective view, showing the table, per se.

FIG. 1 illustrates a table 10. The table 10 includes an upper level 12 and a lower level 14, which each extend in horizontal planes—an upper horizontal plane and a lower horizontal plane, respectively. Each of the upper level 12 and lower level 14 include several platform segments 16 that respectively extend in the horizontal planes thereof.

In the embodiment shown in FIG. 1, the table has three longitudinal sections, including a first section 21, a second section 22, and a middle section 23. The first section 21 and middle section 23 are adjacent sections. Also, the second sections 22 and middle section 23 are adjacent sections. Adjacent sections are joined by table legs 25, which also provide support for the various platform segments 16. Wheels 26 are located beneath the table legs 25 for providing convenient mobility for the table 10.

Figure 2:
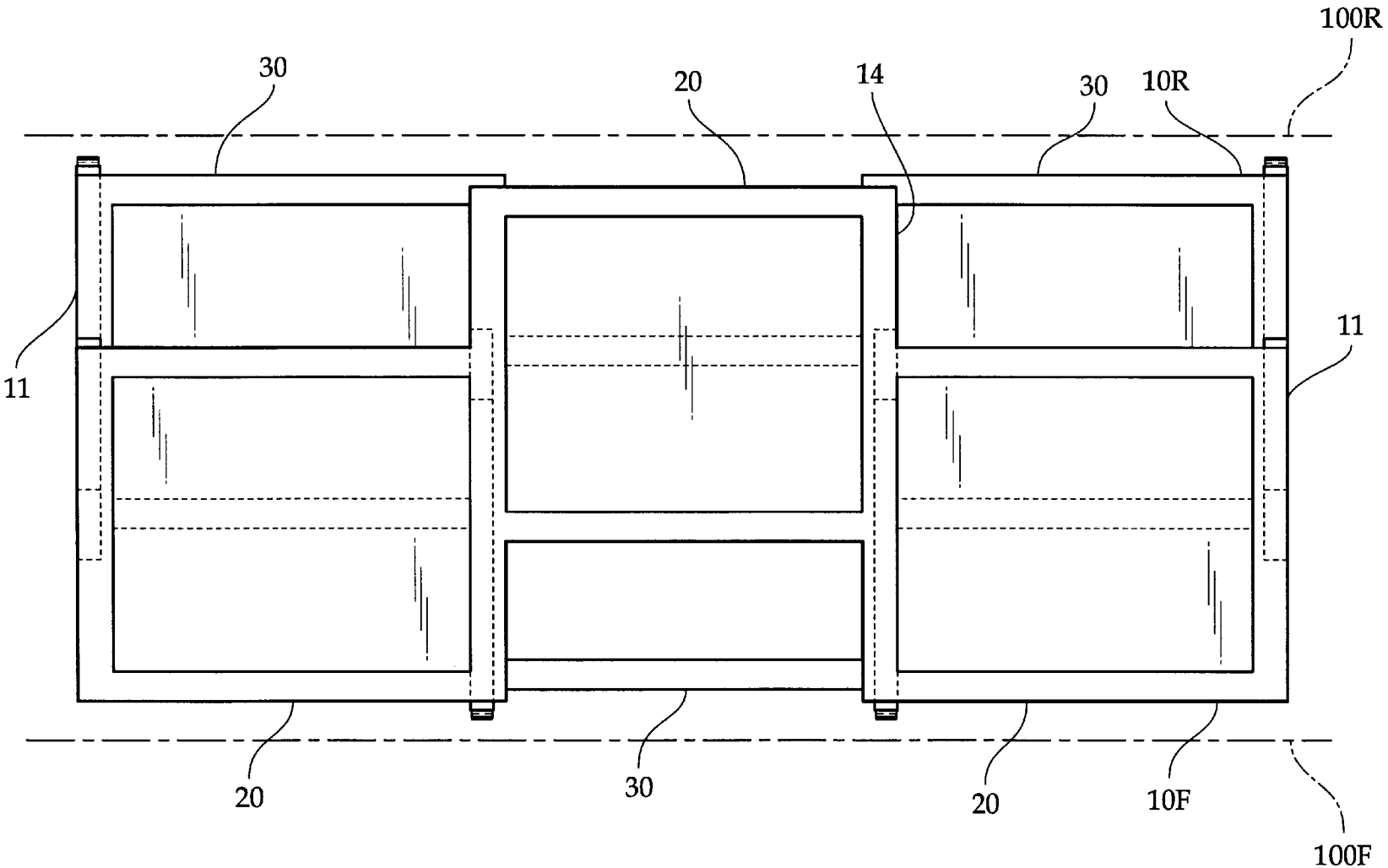
FIG. 2 is a top plan view of the invention, showing the relative positions of the various platform segments.

Since the various platform segments 16 which make up the upper level 12 and lower level 14 are staggered within their respective planes, reference to the top plan view of FIG. 2 is now appropriate for understanding the positional relationships of these various components. In particular, the table 10 has a front 10F and a rear 10R, which are of course interchangeable but which are designated herein for the purpose of establishing a convention for the following discussion. The front 10F and rear 10R correspond to a front vertical plane 100F, and a rear vertical plane 100R, respectively. The table has sides 11 which extend fully between the front 10F and rear 10R. However, it is important to note that none of the platform segments 16 extend fully between the front 10F and rear 10R. Preferably, each platform segment extends approximately two thirds of the way between the front 10F and rear 10R, and each is biased against either the front or the rear. Accordingly, the concept of the "sides" 11 is conceptual only, as the sides are a discontinuous combination of the overlapping platform segments 16 of the upper level 12 and lower level 14, as is apparent from FIG. 1.

In furtherance of one of the primary goals of the invention, the table has seating areas 20 where a person could sit with a tabletop surface immediately in front of him at a comfortable height for working, eating, reading, or the like, and space below the tabletop surface for his legs to extend comfortably. Then with reference again to FIG. 2, people would ordinarily be seated at the front 10F of the table where the upper level 12 of the table extends immediately adjacent to the front vertical plane. Conversely, a person would ordinarily be seated at the rear 10R of the table where the upper level of the table extends immediately adjacent to the rear vertical plane. Accordingly, one seating area 20 is present at the rear 10R and two seating areas 20 are present at the front 10F.

The table also has several non-seating areas 30 which are equal in number to the seating areas 20 and are in opposite positions therefrom. At the non-seating areas 30 of the front 10F, the lower level extends to the substantially the front vertical plane 100F. At the non-seating areas 30 of the rear 10R, the lower level extends to the substantially the rear vertical plane 100R. As seen in FIG. 2, the seating areas 20 and non-seating areas 30 are alternated on each of the table front 10F and table rear 10R, whereas the table front 10F and table rear 10R have opposite configurations of alternating seating 20 and non-seating areas 30. Accordingly at the non-seating areas 30, forwardly staggered platform segments 16 positioned at the lower level 14 provide a convenient storage space for use by people seated at adjacent seating areas 20.

Another way to consider the various platform segments 16 which make up the upper level and lower level, is that they are alternatively staggered toward the front vertical plane and rear vertical plane. This staggered configuration is best accomplished by a careful arrangement of the legs 25. Each of the legs is either angled toward the table front (as it extends upward), or toward the table rear. In the configuration shown in FIG. 1, the table leg 25 located between the first section 21 and middle section 23, and the table leg 25 located between the middle section 23 and second section 22 are both angled toward the table rear 10R. Consequently, the table legs 25 which adjoin only the first section 21 and only the second section 22 are angled toward the table front 10F.

The table has outer edges 40, each having an outer edge center 40C. In following its slant toward the table front 10F, the legs 25 extend along each of the outer edge centers 40C at the first section 21 and at second section 22.

This arrangement of the table legs 25 allows people seated at the seating areas 20 of the first section 21 and second section 22 to get up from the table toward the sides 11 thereof without interference with their feet, calves, or ankles from the table legs 25. Accordingly, banging one's ankles and feet is prevented by this configuration of the table legs.

Further, the table legs 25 do not even interfere with the feet of a person seated at the seating area 20 located in the middle section 23. The person's feet easily slide under the platform segments of the lower level immediately adjacent to said seating area.

Figure 3:
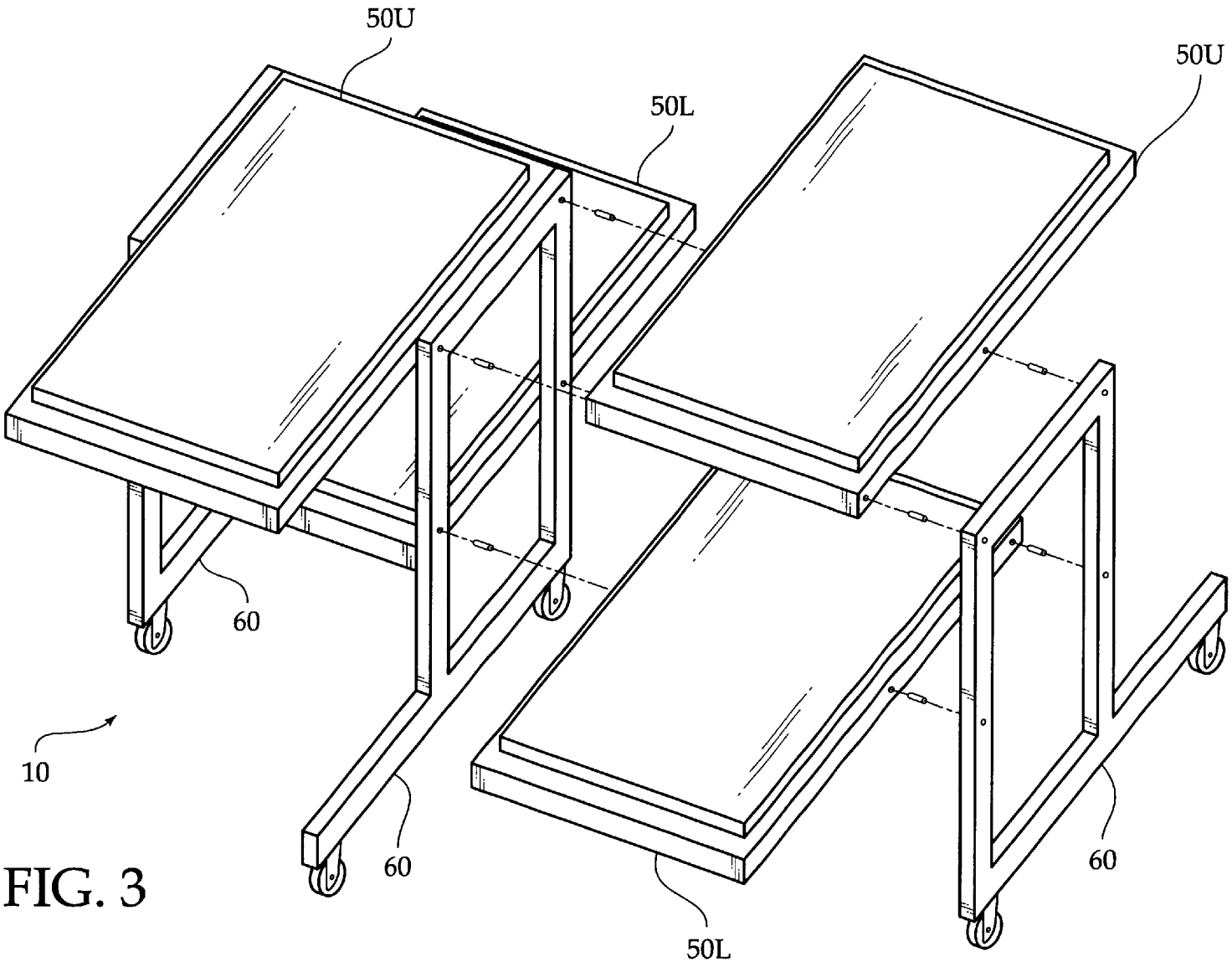
FIG. 3 is an exploded view, showing a further embodiment of the invention which employs modular components.

FIG. 3 provides an example of another embodiment of the invention, in which the table is constructed modularly. From the foregoing discussion, it should be apparent that the table can be made of arbitrary length, wherein each seating area has a complementary non-seating area. In addition, each seating area and non-seating area is located in a distinct section or portion of the table. Accordingly, it should be apparent then that such an arrangement lends itself to modular construction. FIG. 3 provides a workable example of such a modular construction for the table. Each section has an upper panel 50U and a lower panel 50L. The positions of the upper panel 50U and lower panel 50L are staggered by attaching the upper panel 50U and lower panel 50L to a modular leg unit 60. The modular leg units 60 are mounted between each section, and can face in either direction—in furtherance of the principles of preventing interference with the feet of the users while providing structural stability. The hole and peg construction shown in FIG. 3 is illustrative only. In practice, sturdier attachment means would be employed. By combining adjacent sections with alternate seating and non-seating areas by alternately staggering the upper panels 50U and lower panels 50L and alternate positioning of the modular leg units 60 as shown, a construction similar to that shown in FIG. 1 and FIG. 2 can be created. However, using the modular system, a table having two, four, five, or more portions or sections can also be created with equal ease.

It should be understood that the instant discussion focuses on the functional configuration of the table, and not particular details of the table's construction. Thus, structural considerations such as brackets and cross supports are omitted for clarity. In addition, cosmetic design features are simplified or are varied from more aesthetic designs for the purposes of understanding the utilitarian features of the present invention. Accordingly, numerous variations of the table are possible while adhering to the principles of the present invention.

What is claimed is:

1. A table, for use by at least one person, comprising:

a table front and a table rear, wherein a front vertical plane extends vertically at the table front and a rear vertical plane extending vertically at the table rear;

an upper level, extending horizontally;

a lower level, extending horizontally;

at least two seating areas, including at least one located at the table front and at least one located at the table rear, at each of said seating areas the upper level extends substantially to one of the front and the rear vertical plane which is closest to said seating area, and the lower level threat is recessed from said vertical plane so that a person could sit at said seating area with their legs extending beneath the upper level while the lower level does not interfere with their legs; and at least two non-seating areas, including at least one located at the table front and at least one located at the table rear, at each of said non-seating areas the lower level extends substantially to one of the front and the rear vertical plane which is closest to said non-seating area, and the upper level threat is recessed from said vertical plane.

2. The table as recited in claim 1, further comprising at least two adjacent sections, wherein each section has one seating area at one of the table front and table rear, and has one non-seating area at the other of the table front and table rear.

3. The table as recited in claim 2, wherein each section comprises a platform segment at the upper level and a platform segment at the lower level neither of which extend fully between the table front, wherein one of said platform segments is biased toward the table front and the other of said platform segments is biased toward the table rear.

4. The table as recited in claim 3, wherein each section is bordered by a table leg, wherein adjacent sections share a table leg.

5. The table as recited in claim 4, wherein the table legs are angled as they extend upward in a direction selected from toward the table front and toward the table rear.

6. The table as recited in claim 5, wherein the table has three adjoining sections, wherein the table front alternates between seating areas and non-seating areas, and the table rear alternates between seating areas and non-seating areas, such that the table front has two seating areas and one non-seating area, and the table rear has two non-seating areas and one seating area.

7. The table as recited in claim 6, comprising platform sections, wherein distinct coplanar platform segments define the upper level at each of the seating portions, and distinct coplanar platform segments define the lower level at each of the non-seating portions.

8. The table as recited in claim 7, further comprising a first section, a second section, and a middle section.

9. The table as recited in claim 8, wherein the middle section is located between the first section and second section, wherein the first section and second section have outer edges which do not adjoin the middle section, and wherein one table leg extends along each of the outer edges and is angled upward toward the table front.

10. The table as recited in claim 9, wherein the outer edges each have an outer edge center, and wherein the table legs extend along the outer edge center at the lower level and the outer edge center at the upper level.

* * * * *